United States Patent [19]

Ohmatsu

[11] Patent Number: 4,914,884

[45] Date of Patent: Apr. 10, 1990

[54] EXPANSION JOINTS

[76] Inventor: Toshikazu Ohmatsu, 178-1, Bonsai-cho, Ohmiya, Saitama, Japan

[21] Appl. No.: 274,891

[22] Filed: Nov. 22, 1988

[51] Int. Cl.[4] ..... E04B 1/62; E04C 11/02

[52] U.S. Cl. ..... 52/396; 52/573; 404/47

[58] Field of Search ..... 52/573, 396; 404/47, 404/56–58

[56] References Cited

U.S. PATENT DOCUMENTS

| | | | |
|---|---|---|---|
| 3,183,626 | 5/1965 | Schmitt | 52/573 X |
| 3,390,501 | 7/1968 | Driggers | 52/396 X |
| 3,394,639 | 7/1968 | Viehmann | 404/47 |
| 3,417,528 | 12/1968 | Hallock | 52/573 X |
| 3,659,390 | 5/1972 | Balzer et al. | 52/396 X |
| 3,750,359 | 8/1973 | Balzer et al. | 52/573 X |
| 4,566,242 | 1/1986 | Dunsworth | 52/573 |
| 4,601,143 | 7/1986 | O'Keefe et al. | 52/573 X |
| 4,674,252 | 6/1987 | Nicholas et al. | 52/396 |

FOREIGN PATENT DOCUMENTS

| | | | |
|---|---|---|---|
| 2344225 | 3/1975 | Fed. Rep. of Germany | 52/573 |

*Primary Examiner*—Henry E. Raduazo
*Assistant Examiner*—Michele A. Van Patten
*Attorney, Agent, or Firm*—Schwartz & Weinrieb

[57] ABSTRACT

The expansion joint includes a pair of support frames fixed upon steps formed opposite to each other upon both building edges defining a gap therebetween, a connecting cover plate which can slide so as to span both a support frame and a surface base plate so as to extend across the gap defined between the buildings, and a surface dressing structure which is identical to a building surface dressing structure and which is laid upon both surface base plates so as to be visually continuous with the building edge.

6 Claims, 3 Drawing Sheets

EXPANSION JOINTS

FIELD OF THE INVENTION

This invention relates to an expansion joint covering a gap defined between building sections, and more particularly to an expansion joint for absorbing distortion formed within a wall surface or ceiling and the like of a building.

BACKGROUND OF THE INVENTION

Heretofore, in the case of buildings, especially, high-rise buildings or large size buildings, expansion gaps are formed within the floor surface, wall surface or ceiling and the like of the building. Each gap is formed with the objective of preventing damage to the building by means of absorbing or accommodating any distortion as a result of expansion or contractions due to temperature changes within the building or irregular foundation support or distortion as a result of an earthquake and the like, and as a structure for covering the gap, the expansion joint shown in FIG. 5 has heretofore been used. The expansion joint of this kind is constructed in such a way that a cover plate 51 is fixed to a pair of support bases 50 which are fixed to ends of members A, A' of a building defining a gap G therebetween, and in general, a connecting means 52 flexibly connects both support bases 50, 50 so as to span the gap G, and the cover plate 51 of the flat plate type is connected to the connecting means 52 by means of a bolt 53.

Accordingly, when the cover plate 51 comprises a metal plate, there is a problem that the design of the floor surface or wall surface or ceiling surface and the like of the building is divided by means of the cover plate 51 extending along the gap G. Especially, in recent years, as the width of the gap G becomes larger as a result of the tendency of constructing larger size buildings, the width of the cover plate 51 has become correspondingly wider thereby producing a sense of design incompatibility in some cases.

OBJECT OF THE INVENTION

Accordingly, it is an object of this invention to provide an expansion joint of excellent structure, which is designed to be in harmony with the adjacent wall or ceiling surface and the like and to render gap structure of the building inconspicuous in view of the above problem.

SUMMARY OF THE INVENTION

The expansion joint of the present invention comprises a pair of support frames fixed upon stepped or shoulder portions formed upon both building edges defining a gap therebetween, a connecting cover plate which can slide relative to the support frames so as to span both support frames, and a surface base plate contacting the upper surface of the connecting cover plate extending across the aforenoted gap and which is fixed and fastened upon the front edges of both support frames, and a surface dressing structure identical to a building surface dressing structure is laid upon both surface base plates so as to be continuous with the building edge.

Furthermore, this invention achieves the above goal by permitting the disposition of a surface dressing structure equivalent to the building surface dressing structure upon the face of the above mentioned connecting cover plate.

Therefore, any roughening used to secure the dressing structure, such as, for example, dovetail grooves, grids, or small projections, is formed upon the surface base plate which holds the surface dressing structure, or upon the adhering surface of the connecting cover plate, and tiles or clinkers or other dressing materials are directly adhered to the surface thereof.

According to the above formation, the width of the corresponding gap insertion structure is not enlarged by means of the expansion joint because the surface dressing structure which is directly provided upon the surface base plates defining the gap of the building and therefore, the gap appears to remain approximately the same despite the expansion or contraction conditions. In addition, the stepped differences of the surface dressing structure are the same height as that of the surface dressing material, and furthermore, the design of the whole building is not divided, because the dressing surface material disposed upon the connecting cover plate and within the gap is equivalent to the surface dressing material disposed upon the building or structural walls defining the gap.

BRIEF DESCRIPTION OF THE DRAWINGS

The following description relates to the other characteristics and benefits of this invention by reference to the attached drawings in which like reference characters designate like or corresponding parts throughout the several views, and wherein.

DETAILED DESCRIPTION OF THE PREFERRED EMBODIMENT

Figure 1:
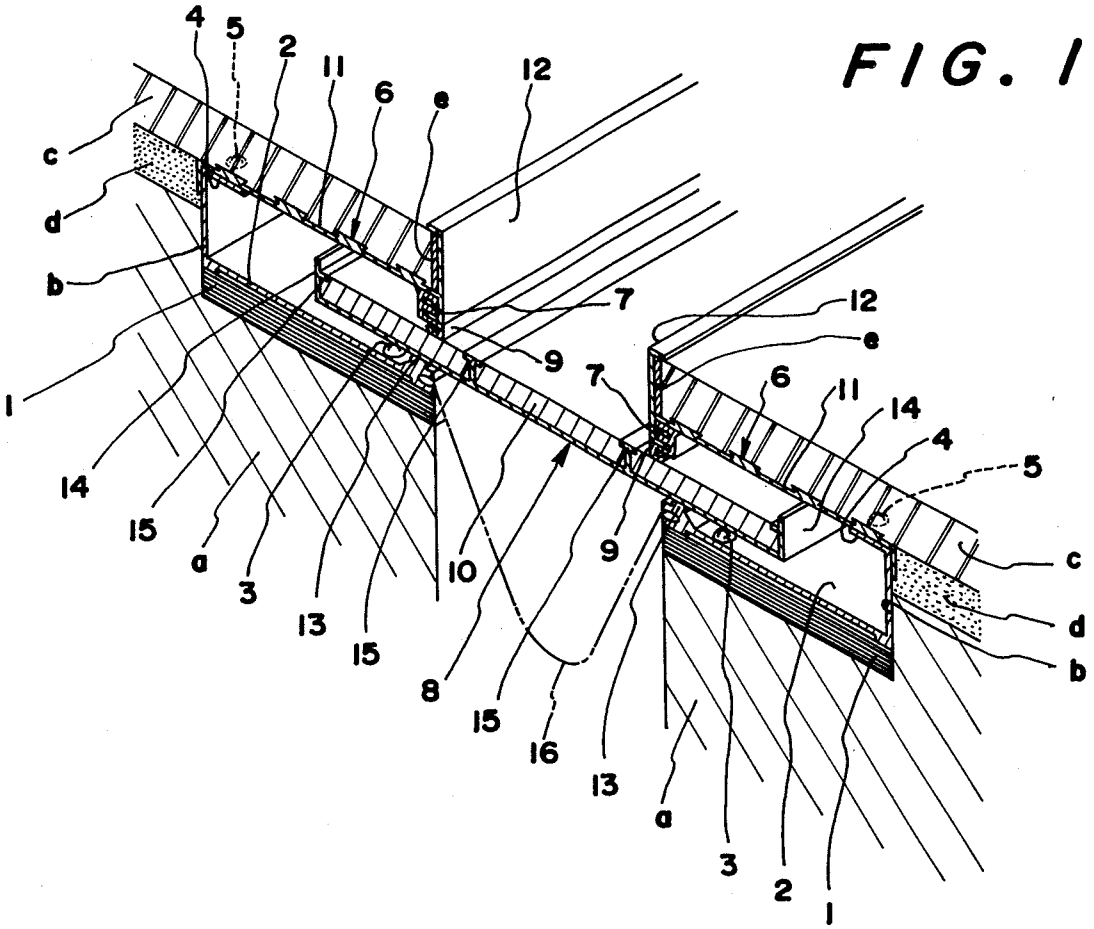
FIG. 1 is a perspective view of a first embodiment of an outer wall expansion joint of this invention.

A first embodiment of an expansion joint of this invention will now be described in accordance with FIG. 1.

Reference numeral 1, 1 denotes a metal plate frame driven into the bottom of each step b, b of buildings a, a defining a gap G therebetween. A pair of approximate sectional ⊐-shaped support frames 2, 2 are connected to a metal plate frame 1 by means of a screw 3 and oppositely fixed thereon. The support frames 2, 2 are then fixed so as to be flush with the finished level of an understructure (bedding material) d disposed upon the stepped portions b,b and a side plate edge 4 is formed at the front of the building a. A surface base plate 6 is connected to the side plate edge 4 by means of a screw 5, and a packing 9, slides upon the upper surface of a surface dressing material 10 which is adhered to a connecting cover plate 8 described below, and is engaged with a packing groove 7 formed upon the rear edge of the surface base plate 6. A lengthwise and crosswise extending dovetail groove 11 is also formed upon the surface thereof and an edge 12 is formed on the end thereof. Reference numeral 8 is a connecting cover plate spanning inside edges 12, 12 and is mounted upon the bottom of both support frames 2, 2, and a surface dressing material 10, such as for example, tiles identical or similar to the below mentioned surface dressing material c, is adhered to the front of both edges 14, 14 and is disposed atop plate 8. The connecting cover plate 8 includes variously shaped locking projections 15, 15, . . . upon the edge members 14 and the bottom plate, and the surface dressing material 10 is therefore securely fixed thereon.

Furthermore, reference numeral 16 is a water stop plate consisting of flexible materials whose edges are engaged with the inside edges 13, 13 . . . of both the support frames 2, 2.

The front of the above-mentioned building a retreats away from the edge of the surface base plate 6, and, after a surface dressing material c is applied to the front of the building a at the same level as the surface base plate 6, the surface dressing material c, such as, for example, tiles, is continuously attached from the understructure d to the edge 12 of the surface base plate 6, and caulking compound e is used to fill any gaps at edge 12.

The expansion joint formed above is therefore seen to comprise the metal plate frame 1 disposed upon the bottom of each step b, b of the buildings a, a respectively, the support frames 2, 2 are connected to each metal plate frame 1 by means of the screw 3, and are opposedly set so as to define the gap G. The screw 5 is unfastened from both the support frames 2, 2 so as to separate the surface base plate 6 from the support frames 2, and the surface dressing material 10 is adhered to the front of both edges 14, 14 of cover plate 8 while supporting or mounting the connecting cover plate 8 of both support frames 2, 2 under these conditions. The surface dressing material 10 is then securely fixed upon the surface of the connecting cover plate 8 by means of a dressing material locking structure comprising a longitudinally extending locking projected strake 15. The surface base plate 6 is fixed by fastening the screw 5, and the surface projecting from the front of the building a is formed. Execution of work is completed in such a way that the surface dressing material c is continuously adhered to the front of the surface base plate 6 by means of an adhesive agent and the like, with the surface dressing material c, such as, for example, tiles supported upon the understructure d, provided upon the front of the building a, thereby obtaining an inconspicuous joint structure.

Figure 2:
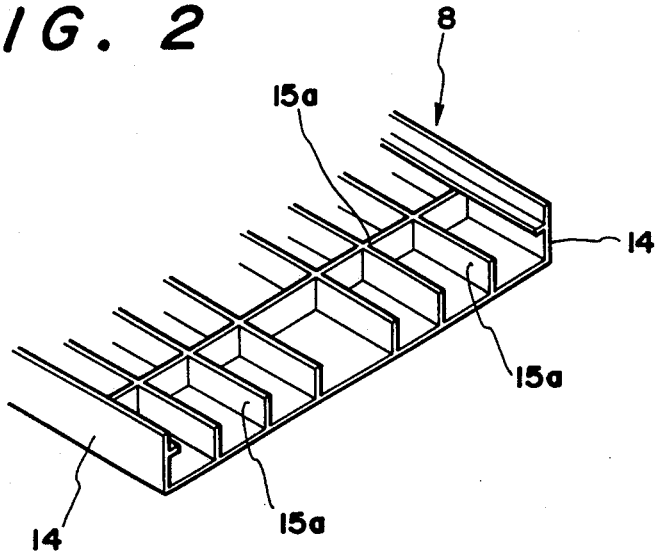
FIG. 2 is a perspective view of a connecting cover plate showing another embodiment of a dressing material securing structure.
Figure 5:
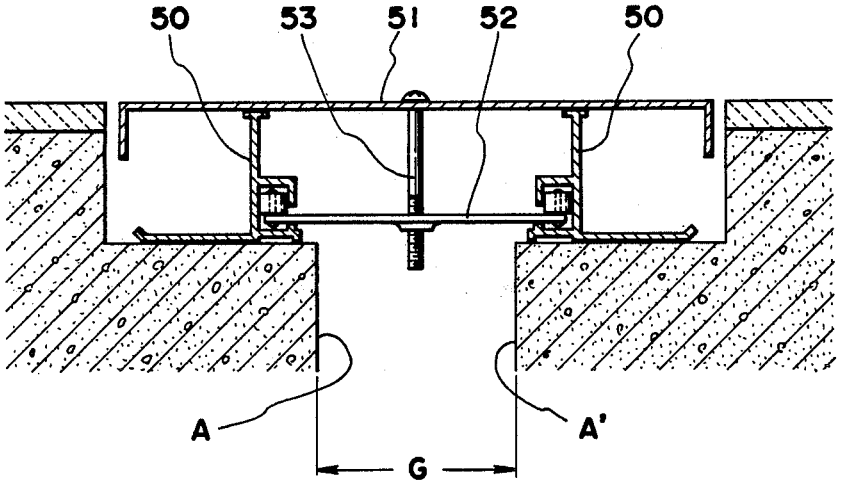
FIG. 5 (PRIOR ART)
FIG. 5 is an elevational cross section showing a conventional expansion joint.

The locking projected strake 15 is described as a dressing material locking structure according to the formation of the above embodiment, but the dressing material locking structure is effective even if it is a grid shaped rib structure 15*a* as shown in FIG. 2. The above embodiment is described in relation to a wall surface structure, but a similar expansion joint can be formed upon ceiling and floor surfaces.

Figure 3:
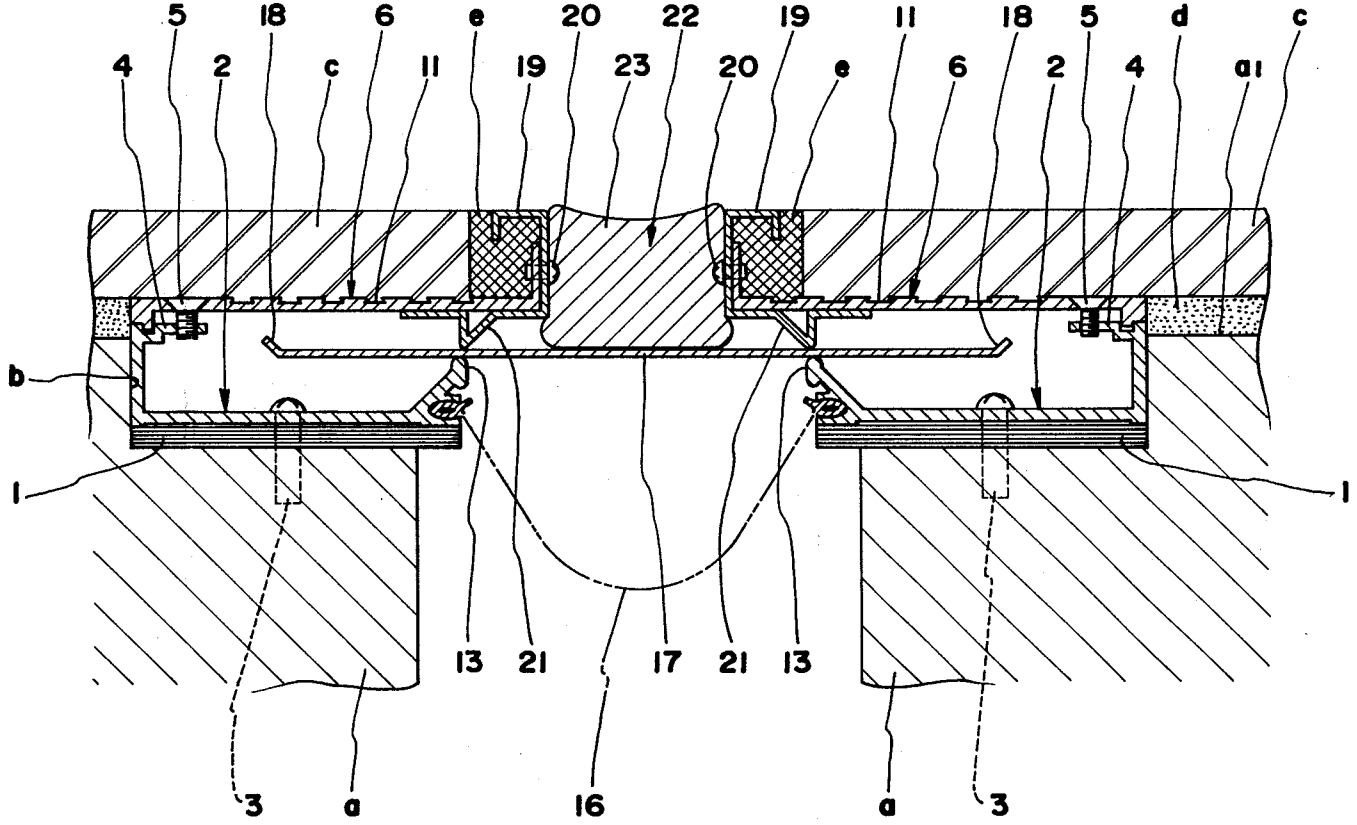
FIG. 3 is an elevational cross section of a second embodiment of the expansion joint of the present invention.

FIG. 3 shows a second embodiment of this invention. Structures similar to the first embodiment described above are omitted from the description and are denoted by the same reference numerals.

Reference numeral 17 is a connecting cover plate spanning inside edges 13, 13 provided upon the bottom plate of both support frames 2, 2 and reinforcing edges 18, 18 are formed upon both free edges thereof. Reference numeral 19 is an edge cap fixed upon the edge of each surface base plate 6 by means of a screw 20, and a sliding rib 21 projecting downwardly from the undersurface side of the surface base plate 6 contacts the upper surface of the above-mentioned connecting cover plate 17, whereby the edge cap 19 is protecting the end of the surface dressing material c. Caulking compound 23, such as for example, a flexible synthetic resin, is filled within a groove 22 formed between the above-mentioned edge caps 19, 19 and the connecting cover plate 17 so as to be at approximately the same level as the surface dressing material c.

Figure 4:
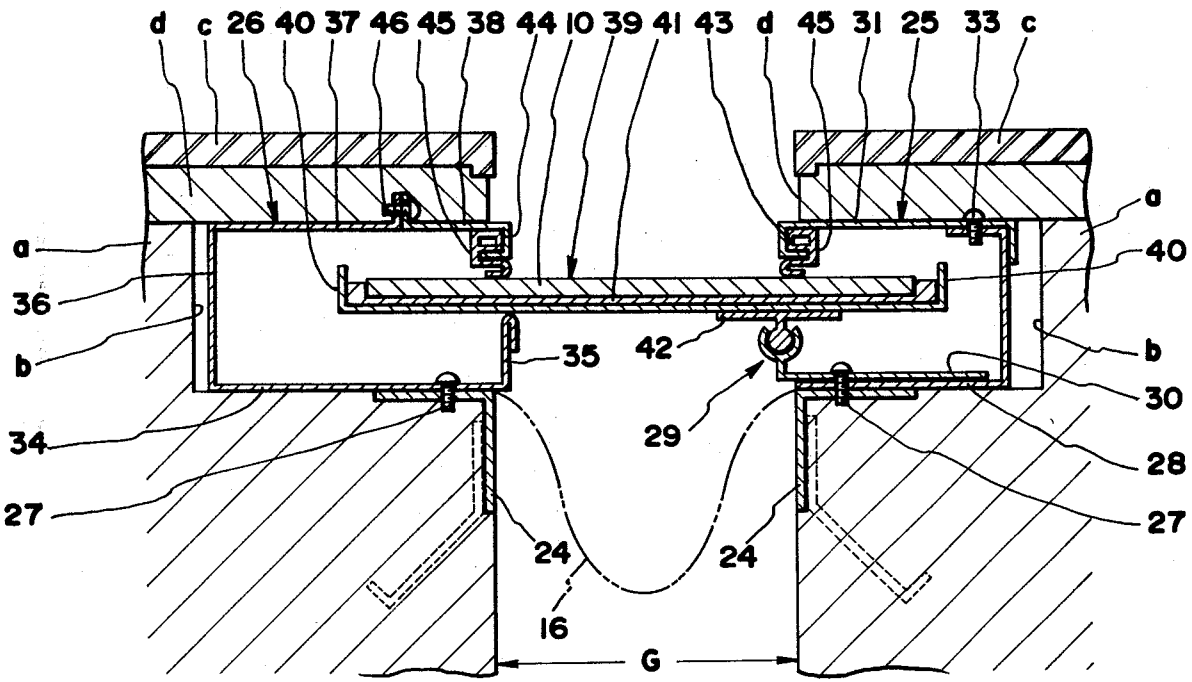
FIG. 4 is an elevational cross section of a third embodiment of the expansion joint of the present invention.

FIG. 4 shows a third embodiment of an expansion joint of this invention.

Reference numeral 24 is an angle iron mounted upon the external corner of each step b of buildings a, a defining the gap G, and the approximate cross section ⊐-shaped support frames 25, 26 are connected and opposedly fixed to the angle iron 24 by means of a screw 27 so as to be engaged with steps b, b. A surface base plate 31 is connected to the front edge of a side plate 36 by means of a screw 33 while an attached plate 30 of a hinge frame 29 fixed at a position across from base plate 31 of support frame 25, is set near the edge of the gap G and atop a bottom plate 28. Another support frame 26 forms a continuous, angular surface base plate 37 along the front edge of another side plate 36 with an inner plate 35 placed at approximately the same distance with respect to the edge as defined by means of the attached plate 30 of the above-mentioned hinge frame 29, and connects an auxiliary surface base plate 38 to the surface base plate 37 by means of a screw 46. A cover connecting plate 39 spanning both the above support frames 25, 26 provides adhesion for surface dressing material 10, such as, for example, tiles, which is equivalent or similar to surface dressing material c, to the front of both edges 40 through means of an understructure (a bedding material) 41. The connecting cover plate 39 has fixed to the undersurface portion thereof an attached plate 42 which, in turn, is connected to the above hinge frame 29, and in addition, the opposite side of plate 39 is supported upon an upstanding inner plate portion 35. Packing 45, 45 slides upon surface dressing material 10 and engaging grooves 43, 44 are formed upon the edge portions of the above-mentioned surface base plate 31 and the auxiliary surface base plate 38 for reception of the packing members 45,45.

According to the above embodiment, each face of the surface base plates 31, 37 and the auxiliary surface base plate 38 are finished at the same level as the front of the buildings a, and the surface dressing material c, such as, for example, tiles, is provided for the building a and the front of the surface base plate 31 through means of the understructure d. In addition, the surface dressing material c, such as, for example, tiles, is provided upon the front of the other building a, the surface base plate 37 and the auxiliary surface base plate 38 through means of the understructure d.

This invention has been described in detail to a certain degree in connection with the preferred embodiments thereof, and it is obvious that various changes or modifications can be made without departing from the spirit and the scope of this invention, and this invention is not restricted to any specified embodiments thereof except as so limited by means of the attached claims.

What is claimed is:

1. An expansion joint for disposition within a gap defined between two building structures, comprising:

a pair of channel-shaped means, each of which has an opening along one side thereof, fixedly secured to respective ones of said two building structures such that said open sides thereof are disposed opposite each other upon opposite sides of said gap;

a first surface dressing structure disposed atop said pair of channel-shaped means and said two building structures so as to substantially extend to edge portions of said two building structures which define said gap;

a cover plate having a width greater than said gap defined between said two building structures such that laterally disposed side portions of said cover plate are slidably disposed within said openings of said channel-shaped means so as to span said gap during expansion and contraction conditions of said expansion joint; and a second surface dressing structure, substantially identical to said first surface dressing structure, disposed atop said cover plate and substantially throughout said width thereof so as to also be disposed within said openings of said channel-shaped members, whereby regardless of said expansion and contraction conditions experienced by said building structures, visual continuity of said building structures, across said gap and said expansion joint, will be effectively preserved by means of said first and second surface dressing structures.

2. An expansion joint as set forth in claim 1, wherein:

said cover plate includes a bottom surface upon which said second surface dressing structure is disposed, and upstanding side surfaces along said laterally disposed side portions thereof for laterally confining said second surface dressing structure upon said bottom surface.

3. An expansion joint as set forth in claim 1, wherein:

said cover plate comprises a grid-type structure having a bottom surface and upstanding rib portions defining a grid structure upon said bottom surface thereof.

4. An expansion joint as set forth in claim 1, further comprising:

packing means, secured to said channel-shaped means at upper end portions thereof which define said openings extending along said one side thereof, for slidably engaging an upper surface portion of said cover plate as said expansion joint experiences said expansion and ocntraction conditions.

5. An expansion joint as set forth in claim 1, further comprising:

retaining means provided upon said channel-shaped means for retaining said first surface dressing structure upon said channel-shaped means.

6. An expansion joint as set forth in claim 5, wherein said retaining means comprises:

dovetailed means formed upon said channel-shaped means for engaging said first surface dressing structure.

* * * * *